United States Patent [19]

LaFlame

[11] Patent Number: 4,605,144

[45] Date of Patent: Aug. 12, 1986

[54] SUPPORT FOR A PERCUSSION INSTRUMENT

[76] Inventor: Thomas R. LaFlame, 107 Noble Ave., Pittsburgh, Pa. 15205

[21] Appl. No.: 723,335

[22] Filed: Apr. 15, 1985

[51] Int. Cl.[4] ..... A45F 3/10

[52] U.S. Cl. ..... 224/265; 224/270; 224/271; 224/910; 84/421

[58] Field of Search ..... 224/265, 910, 201, 255, 224/256, 269, 270, 271, 252; 84/421

[56] References Cited

U.S. PATENT DOCUMENTS

| | | | |
|---|---|---|---|
| 3,021,744 | 2/1962 | Kester | 84/421 |
| 3,106,123 | 8/1976 | Johannsen | 84/421 |
| 3,974,732 | 8/1976 | Kester, Jr. | 84/421 |
| 4,256,007 | 3/1981 | Sreit | 84/421 |
| 4,387,839 | 6/1983 | Dranchak | 224/265 |

*Primary Examiner*—Stephen Marcus
*Assistant Examiner*—David Voorhees
*Attorney, Agent, or Firm*—Thomas H. Murray; Clifford A. Poff

[57] ABSTRACT

A support mounting for support of a percussion instrument such as a drum or the like with respect to a carrier frame wherein the mounting structure includes inner and outer clamp elements which are engageable with a side wall portion of the instrument and an elongated, selectively releasable fastener secures the clamp elements with respect to the carrier frame. A rotary constraint precludes rotation of the instrument with respect to the support mounting and either the elongated fastener or the rotary constraint is effective to maintain the inner and outer clamp elements in clamping engagement with an instrument side wall portion therebetween.

15 Claims, 12 Drawing Figures

SUPPORT FOR A PERCUSSION INSTRUMENT

BACKGROUND OF THE INVENTION

This invention relates to a support for an instrument, particularly a percussion instrument or instruments such as drums or the like. More particularly, the present invention relates to a support apparatus which serves to support an instrument by means of clamp elements which clamp onto opposite sides of a formed surface of the instrument. The clamping action is such that the instrument is constrained against rotation with respect to a carrier frame on which the support apparatus is mounted.

As is known in the art, a carrier for a percussion instrument generally may take the form of a frame-like structure that is suspended from the shoulders of the user by hooks or straps. A portion of the carrier frame projects forwardly from the midriff region of the user and an instrument mount is affixed to the forwardly-projecting frame portion for securing an instrument thereto. Examples of various instrument carriers are disclosed in U.S. Pat. Nos. 3,106,123 3,021,744 3,974,732 and 4,256,007, as well as in U.S. Pat. No. 4,453,422 of the inventor herein.

An instrument carrier preferably is of a design to provide maximum comfort for the user. Marching bands often are required to execute intricate and precisely time marching routines in the course of a show. In the case of a percussionist, the weight of the drums carried while executing such routines may be quite large, up to or in excess of 70 pounds, for example. In addition, the percussionist may often carry a number of drums and must play all of them at various times during the show.

Becuase of the extreme physical demands upon the marching percussionist, in addition to the demands of competent musicianship, improved structures for mounting and supporting drums to be carried by a marching percussionist have long been sought. The desirable qualities for such structures include not only minimum weight for comfort but also a degree of versatility and adaptability that will permit a minimum of different structural elements to support a variety of drum designs and drum configurations. In addition, it is considered desirable that the mounting hardware be compact and unobtrusive since the drum or drums alone may well be large and unwieldy without the additional weight and space requirements of large and complex mounting hardware systems.

SUMMARY OF THE INVENTION

The present invention contemplates an improved mounting apparatus for securing a drum or drums with respect to a carrier frame that is adapted to be worn by a percussionist.

The invention contemplates generally a mounting assembly including a clamp apparatus having formed clamp jaws which conform to the formed side wall of a drum. The jaw elements are placed on oppoiste sides of the drum side wall to engage the drum side wall therebetween by means of releasable tension elements which extend through the drum side wall to secure the respective jaw elements in clamping engagement therewith. The curvature of the jaw elements conforms to the cylindrical drum side wall such that the clamping engagement thereof on the drum side wall tends to prevent rotation of the drum with respect to the mounting clamp apparatus, thereby maintaining the drum in an upright orientation.

The invention also contemplates a plurality of laterally-spaced drum side wall engaging elements which cooperate with the clamp structure to further constrain the drum in an upright orientation and preclude rotation thereof about the mounting assembly. In one embodiment, the side wall engaging elements include through bolts or other mechanical fastening devices which serve to secure the clamp jaws together in clamping engagement with the drum side wall. In another embodiment, the drum side wall engaging elements include cooperating pairs of conical projections formed on the respective jaws of a clamp member, which projections engage opposite sides of the drum side wall when the clamp elements are drawn into clamping engagement therewith.

The invention further contemplates the employment of resilient clamp jaw face elements formed from a suitable elastomeric material to provide for resilient retention of the drum mounted thereon. The jaw face elements are selectively removable and may be provided with a variety of face curvatures to accommodate a wide range of drum side wall curvatures corresponding to different sizes and types of drums.

The invention further contemplates a quick-release retention element whereby the drum support element remains clamped to the side wall of a drum and is engageable by the quick-release retention element to secure the support element and, therefore, the drum itself, to a carrier frame.

The above and other features of the invention are embodied in a structure of simplified design requiring only a minimum of different elements.

It is, therefore, one object of the invention to provide an improved and simplified drum support apparatus for support of a drum upon a carrier frame.

Another object of the invention is to provide a drum support having cooperating curved jaw elements which are engageable with a cylindrical drum side wall to clamp the drum therebetween.

A further object of the invention is to provide such a drum support with interchangeable jaw elements, preferably of resilient elastomeric material which offers a variety of curvatures to accommodate different sized drums.

Yet another object of the invention is to provide a drum support which is effective to retain a drum in an upright orientation with respect to a carrier frame.

Still another object of the invention is to provide a drum support which is affixed to a drum and is cooperable with a quick-release attachment structure for securing the support and, thus the drum, to a carrier frame.

These and other objects and further advantages of the invention will be more readily appreciated upon consideration of the following description and the accompanying drawings, in which.

Figures 1, 2:
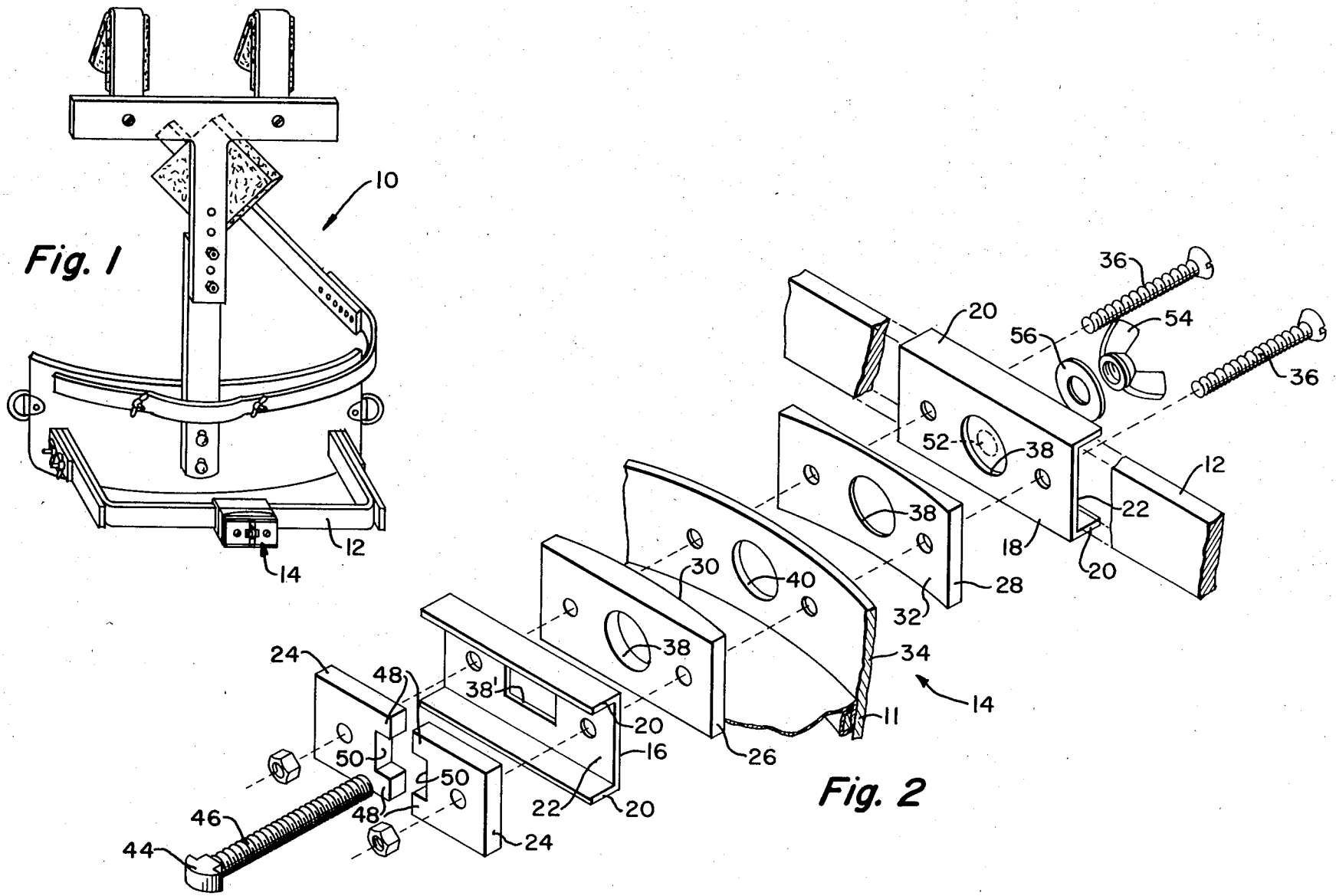
FIG. 1 is a perspective view of a carrier frame including a drum support according to one embodiment of the instant invention.
FIG. 2 is an exploded perspective view of a drum support according to one presently-preferred embodiment of the invention.

There is generally indicated at 10 in FIG. 1, an instrument carrier which includes a forwardly-projecting frame portion 14 having mounted thereon a drum mounting assembly 14 according to one presently-preferred embodiment of the instant invention. The carrier 10, per se, is generally well known to those versed in the art, for example as described in U.S. Pat. No. 4,453,442, and further detailed description thereof thus is unnecessary for an understanding of the present invention, which concerns the mounting assembly 14 and the manner of securing same to a drum and to a support member such as frame portion 12 for support of the drum by such a carrier 10.

In FIGS. 2-5, mounting assembly 14 is shown in detail as comprising respective inner and outer, preferably identical elongated channel menbers 16 and 18, each having a pair of laterally, spaced-apart, longitudinally-extending flange portions 20 which project outwardly to form therebetween an outwardly-facing recess 22 in each member 16, 18. The recess 22 in member 18 is dimensioned to receive a carrier member such as frame portion 12 while the recess 22 in member 16 receives formed filler blocks 24 whose purpose is described hereinbelow.

Clamp jaw elements 26, 28 are disposed adjacent the inner side (i.e., the side opposite the recess 22) of each channel member 16, 18, respectively. The clamp jaw elements 26, 28 have respective confronting curved surfaces 30, 32 which conform to the cylindrical side wall 34 of a given size drum 11. Of course, jaw element surfaces 30, 32 may be provided with any suitable curvature to conform with the side wall of any selected drum. Additionally, jaw elements 26, 28 preferably are of resilient elastomeric material whereby minor variations between the jaw surface curvature and a drum side wall may be accommodated by resilient deformation of the jaw elements, as described hereinbelow.

In practice, the side wall portion 34 of drum 11 is sandwiched between the jaw elements 26, 28 which are then backed up by respective channel elements 16, 18. Filler blocks 24 are positioned in the recess 22 of channel member 16 and the entire assembly is secured in clamping engagement on the drum side wall 34 by mechanical fasteners such as a pair of screw and nut sets 36 which are passed through suitably formed, aligned bores in the clamp elements described and drawn tight to securely clamp the drum side wall 34. As the fasteners 36 are tightened down, the elastomeric jaw elements 26, 28 may deform to accommodate minor deviations of clamp jaw surface profile from the drum side wall profile. The resiliency of the material also provides a degree of flexibility in the drum mounting and reduces the transmission of vibration between the drum 11 and carrier 10. It will be noted that the fasteners 36 serve to secure the drum against rotation with respect to the mounting assembly 14.

Figure 4:
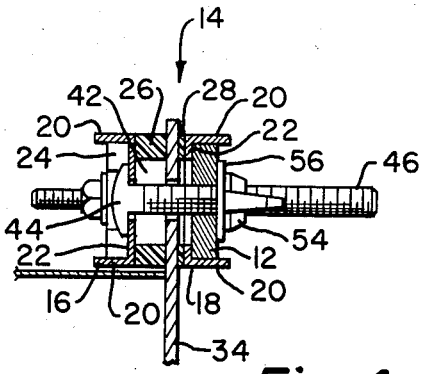
FIG. 4 is a sectional view taken on line IV—IV of FIG. 3.
Figure 5:
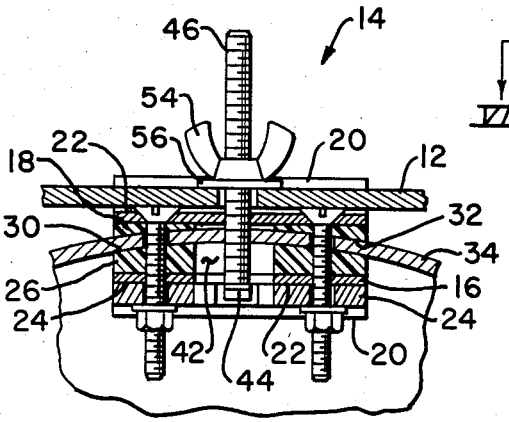
FIG. 5 is a sectional view taken on line V—V of FIG. 3.
Figure 6:
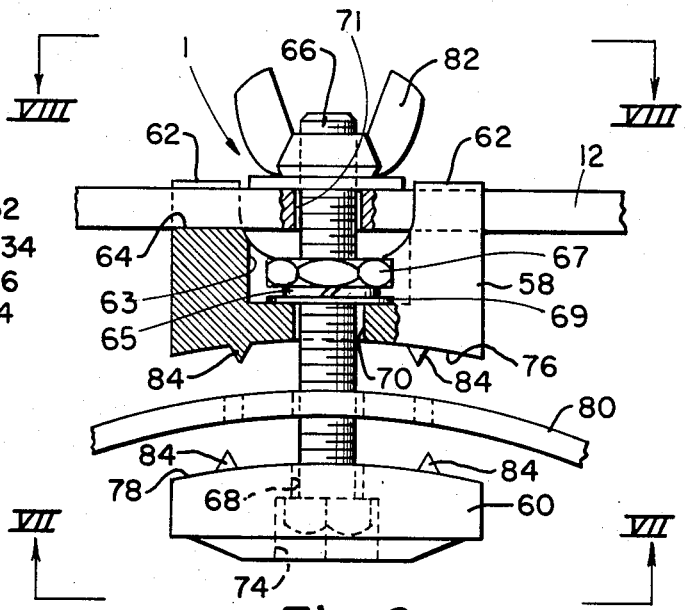
FIG. 6 is a top plan view, partially in section, of a drum support according to another preferred embodiment of the invention.
Figure 7:
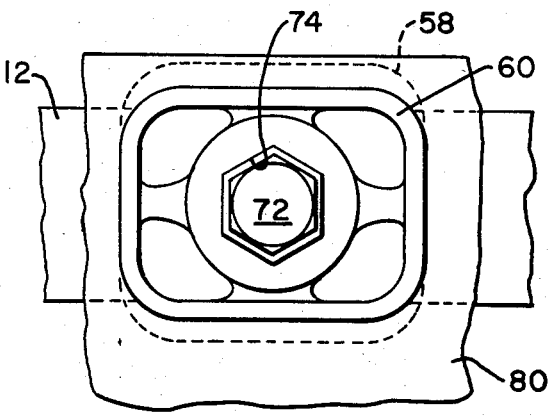
FIG. 7 is a frontal elevation taken on line VII—VII of FIG. 6.
Figure 8:
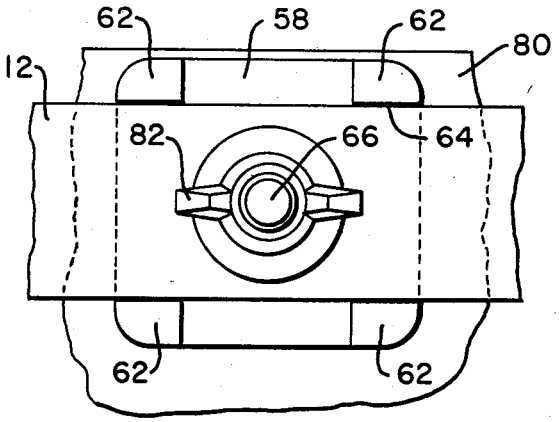
FIG. 8 is a rear elevation taken on line VIII—VIII of FIG. 6.
Figure 9:
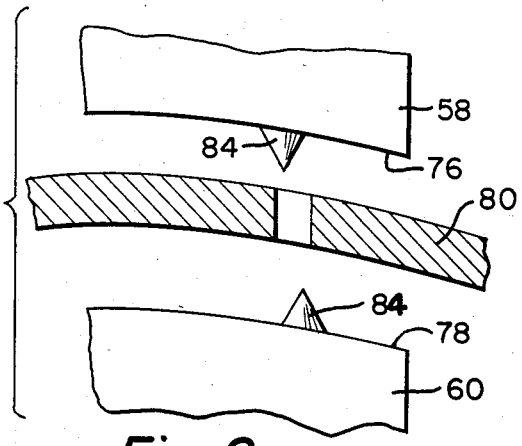
FIG. 9 is a fragmentary portion of FIG. 6 showing the drum support clamp jaws disengaged from the drum side wall.
Figure 10:
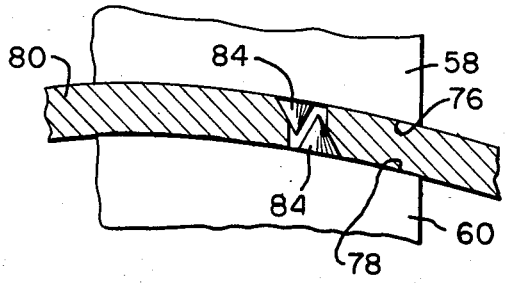
FIG. 10 is a view similar to FIG. 9 showing the support clamp jaws engaging the drum side wall.

The mounting assembly 14, as described, may be mounted on the side wall of drum 11 between the drum heads or, alternatively, on a portion of the side wall or a rim which projects outwardly of the drum head, as shown in FIGS. 2 and 4, for example.

An enlarged central aperture 38 is provided in each of elements 16, 26, 28 and 18, and a corresponding aperture 40 is provided in drum side wall 34 such that when assembly 14 is secured to a drum side wall as above described, the apertures 38 and 40 are aligned to provide a continuous through opening 42 (best shown in FIG. 5) of sufficient lateral dimension to receive the toggle head 44 of a bolt 46. For simplicity, apertures 38 and 40 may generally be circular so long as at least the aperture in member 16, designated 38', is suitably dimensioned to selectively release or retain toggle head 44 according to its angular orientation. For example, as shown, aperture 38' may be an elongated slot of sufficient length to allow toggle head 44 to pass through when aligned therewith, and of sufficiently limited width to preclude passage of toggle head 44 when oriented transversely of the slot 38'.

Each filler block 24 is provided with a pair of ears or lugs 48 which define therebetween a recess 50. When blocks 24 are retained within recess 22 of member 16 in their assembled position, the respective ears 48 thereof are positioned in spaced, confronting relationship with sufficient space therebetween to receive the opposite ends of toggle head 44 in a manner to constrain the head 44 against rotation. Additionally recess 50 provides sufficient clearance to permit head 44 to pass when aligned therewith.

Figure 3:
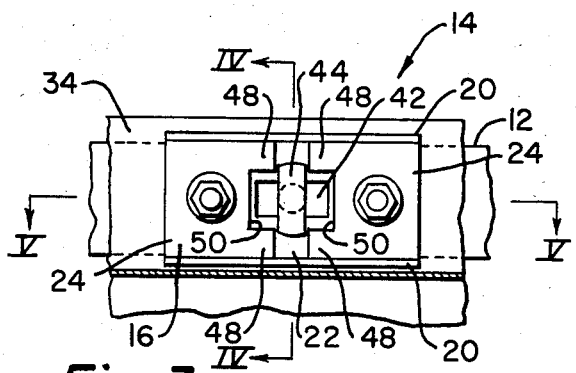
FIG. 3 is a frontal elevation of the assembled support of FIG. 2.

Toggle head bolt 46 normally is retained within a through opening 52 in frame portion 12 and has a wing nut 54 and washer 56 threaded thereon. Accordingly, to mount a drum securely on frame portion 12, the assembly 14 is secured to the drum and is positioned with flanges 20 of member 18 overlying opposite lateral sides of frame portion 12. The toggle head 44 is then oriented in the horizontal direction, as shown in FIG. 2, and is passed through opening 42 a sufficient distance to clear ears 48. The bolt 46 is then turned 90 degrees to align toggle head 44 in the vertical orientation, as shown in FIGS. 3 and 4, and the wing nut 54 is tightened down to draw toggle head 44 into engagement with member 16 between the pairs of ears 48. As the ears 48 project into the envelope of space required for rotation of head 44, the bolt 46 cannot rotate and, therefore, cannot spontaneously disengage from assembly 14, when the head 44 is positioned transversely of slot 38' and secured by wing nut 54.

In an alternative embodiment of the invention as shown in FIGS. 6, 7, 8, 9 and 10, a clamp assembly 1 includes rigid outer and inner clamp jaw elements 58, 60 of cast aluminum or the like. Element 58 includes outwardly-projecting abutments 62 adjacent the corners thereof which define therebetween a recess 64 to receive frame portion 12. A threaded fastener such as a bolt 66 is passed through respective aligned apertures 68, 70 in members 60, 58, and the bolt head 72, prefereably a hex head, is received into a recess 74 of like configuration to thereby constrain the bolt 66 against axial rotation.

The clamp elements 58, 60 are also provided with curved, confronting clamping faces 76, 78 which conform to the curvature of a cylindrical drum side wall 80 of given radius. Accordingly, drum side wall 80 may be clamped between clamp jaw elements 58, 60 by means of a nut 67 threaded onto bolt 66 and tightened down upon a lock washer 65 and a flat washer 69 within a central recess 63 formed in member 58. Preferably, the recess 74 provides a sight interference fit with bolt head 72 to frictionally maintain the bolt head 72 therein, and in addition the respective clamp jaw elements preferably are provided with retention structures to retain same in engagement with the drum side wall 80. For example, curved surfaces 76, 78 may be provided with cooperating pairs of conical projections 84 which engage preformed bores 86 in drum side wall 80. The assembled clamp 1 is secured with respect to frame portion 12 by receiving the frame portion 12 into recess 64, as above noted, such that bolt 66 extends through a bore 71 in frame portion 12, a wing nut 82 is threaded onto bolt 66 and tightened down to secure clamp 1 on frame portion 12.

In a further alternative embodiment of the invention, a plurality of drums 88 may be supported with respect to the support frame portion 12 by means of an elongated mounting bracket 90 having a central flanged portion 92 which receives the frame 12 and is secured thereto by a through bolt and wing nut assembly 94 substantially as above described. The bracket 90 is provided with either a toggle bolt head passsed through an arrangement as described above with reference to the embodiment of FIGS. 2 through 5, or an interference fit bolt retention structure as described with reference to the embodiment of FIGS. 6 through 10. The bracket 90 thus is secured by a bolt and wing nut assembly 94 to frame 12 and the flanges of portion 92 preclude rotation of the bracket 90 with respect to frame 12.

Elongated arms 96 extend in opposite lateral directions frame bracket portion 92, and each has an integral clamp jaw portion 98 adjacent the free end thereof. A cooperating clamp jaw element 100 is secured with respect to each clamp portion 98 as by a bolt, hex nut, and lock washer assembly 102 which is similar in all salient respects to the bolt, nut and washer elements 66, 65, 67 and 69 of FIG. 6. Clamp jaw elements 98 and 100 thus are operable to secure a drum therebetween as above described with reference to the embodiment of FIGS. 2–5 or the embodiment of FIGS. 6–10. Accordingly, each pair of clamp jaw elements 90, 100 secures a drum 88 and prevents rotation thereof in the clamp by structure similar in all respects to the above-described with reference to bolts 36 or concial projections 84.

It is noted that the bolt employed in clamping bolt assembly 102 is suitably foreshortened to avoid interference thereof with frame portion 12.

Figure 11:
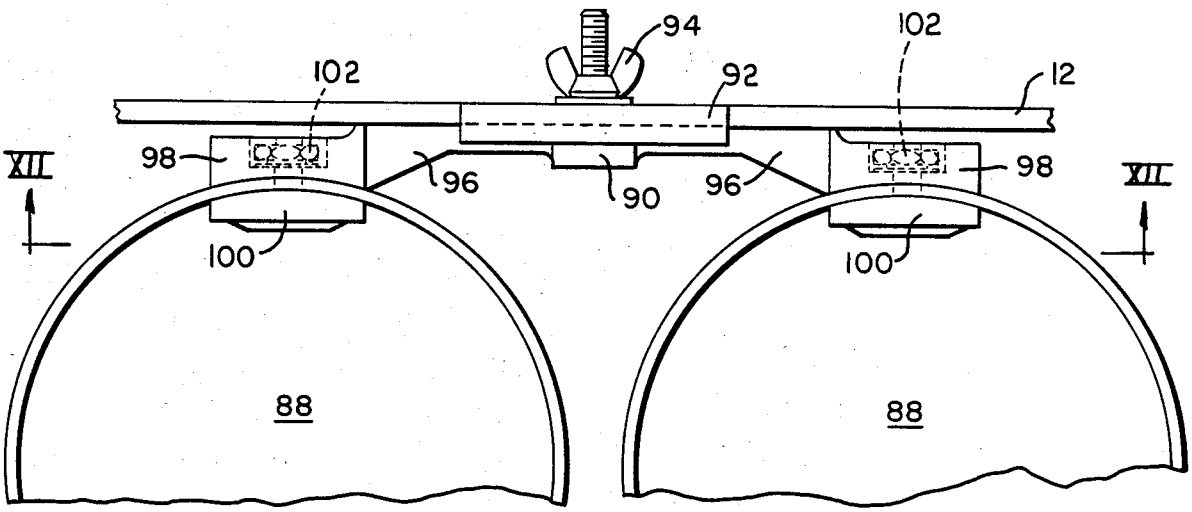
FIG. 11 is a top plan view of another embodiment of the invention.
Figure 12:
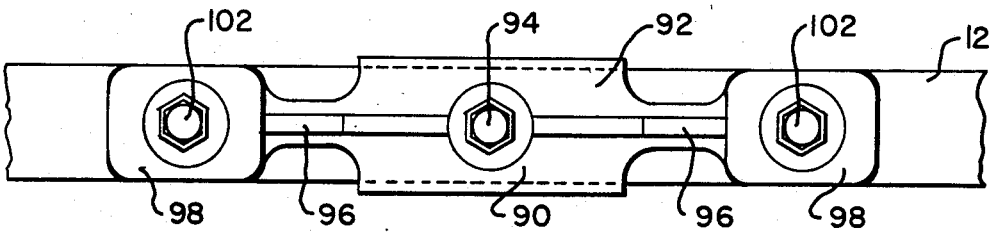
FIG. 12 is a frontal elevation taken generally on line XII—XII of FIG. 11, with the drums removed.

Of course, the curved jaw surfaces 76, 78 (FIG. 6) of the corresponding jaw surfaces in the embodiment of FIGS. 11 and 12, may be surface portions of a removable jaw element of selected material and radius, just as provided for in the embodiment of FIGS. 2–5.

This and various other modifications and alternative embodiments having been contemplated by the inventor, it is intended that the invention be construed as broadly as permitted by the scope of the claims which are appended hereto, and which are to be interpreted in light of this description.

I claim as my invention:

1. A mounting structure for supporting a drum or like instrument with respect to an instrument carrier frame comprising:

a clamp means adapted to be secured to such a drum;

said clamp means including inner and outer clamp elements and respective inner and outer confronting clamp surface means having cooperable surface profiles which are adapted to engage respective inner and outer surfaces of a side wall portion of such an instrument to secure the instrument between said inner and outer clamp elements;

said outer clamp element being engageable with such a carrier frame for non-rotary support thereby;

selectively releasable securing means cooperable with said clamp means for selectively securing and releasing said clamp means with respect to such a carrier frame;

laterally-spaced rotary constraint means associated with said clamp surface means for engaging such an instrument side wall portion in a manner to constrain the instrument against rotation with respect to said clamp means, and at least one of said securing means and said rotary constraint means being effective to maintain said inner and outer clamp elements in clamping engagement with such an instrument side wall portion therebetween.

2. The mounting structure as claimed in claim 1 wherein said securing means includes an elongated, selectively releasable fastener which extends centrally through said clamp means and is passed through such carrier frame to secure said clamp means with respect to such frame.

3. The mounting structure as claimed in claim 2 wherein said elongated fastener includes an enlarged head portion which is engageable with said inner clamp element for retention thereof with respect to such a frame.

4. The mounting structure as claimed in claim 3 wherein said outer clamp element includes outward projections which are adapted to straddle a member of such a frame for such non-rotary support by the frame.

5. The mounting structure as claimed in claim 4 wherein said clamp means includes a central through opening which receives said elongated fastener, said through opening being configured to permit said enlarged head portion to pass therethrough to selectively secure or release said clamp means with respect to such a carrier frame.

6. The mounting structure as claimed in claim 5 wherein said enlarged portion is a toggle head and said through opening includes a portion thereof formed by said inner clamp element which permits said toggle head to pass therethrough in selected rotary positions thereof and restrains said toggle head against passage therethrough in other rotary positions thereof whereat said toggle head is seated upon said inner clamp element.

7. The mounting structure as claimed in claim 6 wherein said portion of said through opening includes lug means which preclude rotation of said toggle head to said selected positions when said toggle head is seated upon said inner clamp element.

8. The mounting structure as claimed in claim 7 wherein said rotary constraint means includes other elongated fasteners which pass through said inner and outer clamp elements to maintain said inner and outer clamp elements in clamping engagement with an instrument side wall portion therebetween.

9. The mounting structure as claimed in claim 8 wherein said clamp surface means are resiliently deformable clamp jaw members.

10. The mounting structure as claimed in claim 8 wherein said clamp jaw members include generally cylindrical engagement surfaces which conform to the cylindrical side wall of a selected size drum.

11. The mounting structure as claimed in claim 10 wherein said inner and outer clamp elements are substantially indentical.

12. The mounting structure as claimed in claim 4 wherein said rotary constraint means includes a plurality of conical projections protruding from each said clamp surface means for engagement with such an instrument side wall portion.

13. The mounting structure as claimed in claim 12 wherein said enlarged head portion is cooperable with a formed recess in said inner clamp element for frictional retention thereby.

14. The mounting structure as claimed in claim 13 wherein said clamp surface means include generally cylindrical engagement surfaces which conform to the cylindrical side wall of a selected size drum.

15. The mounting structure as claimed in claim 14 wherein said inner and outer clamp elements are rigid elements having said clamp surface means formed thereon.

* * * * *